US010194504B2

(12) United States Patent
Mitze

(10) Patent No.: US 10,194,504 B2
(45) Date of Patent: Jan. 29, 2019

(54) LIGHTING SYSTEM

(71) Applicant: LEDVANCE GmbH, Garching bei München (DE)

(72) Inventor: Andreas Mitze, Munich (DE)

(73) Assignee: LEDVANCE GMBH, Garching Bei München (DE)

( * ) Notice: Subject to any disclaimer, the term of this patent is extended or adjusted under 35 U.S.C. 154(b) by 0 days.

(21) Appl. No.: 15/805,545

(22) Filed: Nov. 7, 2017

(65) Prior Publication Data

US 2018/0139808 A1 May 17, 2018

(30) Foreign Application Priority Data

Nov. 15, 2016 (DE) ..... 10 2016 121 930

(51) Int. Cl.
*H05B 33/00* (2006.01)
*H05B 33/08* (2006.01)

(52) U.S. Cl.
CPC ..... *H05B 33/089* (2013.01); *H05B 33/0827* (2013.01)

(58) Field of Classification Search
CPC ..... H05B 33/0815; H05B 37/0272; H05B 33/0845; H05B 33/089; H05B 33/0851; H05B 33/0896; H05B 33/0812; H05B 33/0827; H05B 37/02; H05B 37/0227; H05B 37/0281; H05B 33/0857; H05B 37/0218
See application file for complete search history.

(56) References Cited

FOREIGN PATENT DOCUMENTS

| | | | |
|---|---|---|---|
| DE | 39 13 877 | A1 | 10/1990 |
| DE | 101 21 380 | A1 | 12/2002 |
| DE | 102 36 862 | A1 | 3/2004 |
| DE | 103 45 422 | A1 | 4/2004 |
| DE | 10 2006 015 053 | A1 | 10/2006 |

OTHER PUBLICATIONS

Search Report for corresponding DE application 10 2016 121 930.4, dated Aug. 18, 2017 (8 pages).

*Primary Examiner* — Monica C King
(74) *Attorney, Agent, or Firm* — Hayes Soloway PC

(57) ABSTRACT

A lighting system is provided. The lighting system includes at least one light-emitting diode and a monitoring output, and a fault signal is present at the monitoring output in the event of a defect of the light-emitting diode during operation of the lighting system. The lighting system also includes a switch for switching a connection between a current source and the light-emitting diode. The lighting system further includes a comparator which is coupled with the monitoring output and the switch. The current source is disconnected from the light-emitting diode in an activated state of the switch, and the comparator is configured to switch the switch into the activated state when the fault signal is present at the monitoring output.

13 Claims, 2 Drawing Sheets

LIGHTING SYSTEM

CROSS-REFERENCE TO RELATED APPLICATION AND PRIORITY

This patent application claims priority from German Patent Application No. 10 2016 121 930.4, filed on Nov. 15, 2016, which is herein incorporated by reference in its entirety.

TECHNICAL FIELD

The present invention relates to a lighting system, in particular for an LED retrofit lamp.

Lighting modules for LED lamps, such as, for example, LED retrofit lamps, generally contain lighting systems having a plurality of light-emitting diodes. The problem can arise that a defect or fault, as the case may be, in one of the light-emitting diodes, such as, for example, a short circuit and/or load shedding of a light-emitting diode, leads to uncontrollable temperature increases in the lighting modules. This can result in damage to an electronic ballast of the lighting module and/or to further electronics of the lamp or of the lighting module, as the case may be. It is further possible that further lighting modules and/or lamps which are electronically coupled with the defective lighting module, for example, may be damaged by such a defect. In addition, such an uncontrollable temperature increase involves safety risks when operating the LED lamp.

PRESENTATION OF THE INVENTION

Accordingly, it is an object of the invention to provide a lighting system which allows a defective light-emitting diode to disconnected, in particular automatically, from a current source of the lighting system. This object is achieved by a lighting system having the features of claim 1. Advantageous further developments will become apparent from the dependent claims.

There is accordingly proposed a lighting system comprising at least one light-emitting diode and a monitoring output at which a fault signal is present in the case of a defect in the light-emitting diode during operation of the lighting system. The lighting system further comprises a switch for switching a connection between a current source and the light-emitting diode, and a comparator, which is coupled with the monitoring output and the switch. In an activated state of the switch, the current source is disconnected from the light-emitting diode. Furthermore, the comparator is configured to switch the switch into the activated state when the fault signal is present at the monitoring output.

By using the comparator coupled with the switch it is possible to detect a defective light-emitting diode of the lighting system and safely disconnect the defective light-emitting diode from a current source of the lighting system. The expression "current source" here and in the following can also include a voltage source, which provides a constant voltage. However, the current source is preferably in such a form that a fixed and/or constant current is provided. For example, the current source is coupled with an electronic ballast or is an electronic ballast, which serves to operate the lighting system or a lamp with the lighting system, as the case may be. Disconnection of the current source from the defective light-emitting diode thus leads to disconnection of the electronic ballast from the defective light-emitting diode. In particular, safety standard IEC 62368-1 (Version 2.0, February 2014), which relates to unusual or abnormal operating states and faults of light-emitting diodes, can thereby be complied with.

The lighting system may be a lighting module for an LED lamp, for example a so-called LED retrofit lamp. The lighting system can have at least one LED chain, preferably a plurality of LED chains, an LED chain containing at least one light-emitting diode, preferably a plurality of light-emitting diodes. An LED chain can be in the form of a so-called LED filament, for example, or can contain such an LED filament. In the case of a plurality of LED chains, the LED chains can be connected in parallel with one another. In the lighting system described herein it is possible that, in the event of a defect in one, in particular a single, light-emitting diode in an LED chain, all the LED chains are disconnected from the current source.

The defect in a light-emitting diode can be a short circuit of the light-emitting diode and/or load shedding of the light-emitting diode. In the case of a short circuit, the current flow within the defective light-emitting diode and/or in light-emitting diodes connected in series with the defective light-emitting diode increases. In the case of load shedding, the light-emitting diode is open, as it were, and the current flow falls almost to zero. This can affect further light-emitting diodes connected in parallel with the defective light-emitting diode, in which the current correspondingly increases.

It is possible that the comparator comprises a comparator input and a comparator output. The control signal is preferably generated at the comparator output. The comparator input can be connected to the monitoring output. The fault signal is then an input signal of the comparator. Here and in the following, a "signal" is to be understood as being a voltage level or voltage signal. The comparator output can be connected to the switch and optionally to a relay. The control signal is then an output signal of the comparator. In particular, the control signal can serve to activate or optionally deactivate the switch. The comparator preferably performs a comparison between the input signal present at the comparator input and a threshold voltage and delivers two defined output levels ("on" and "off") at the comparator output in dependence on the magnitude of the input signal. The "off" state can correspond, for example, to a rest state (delay mode) of the comparator. The threshold voltage can be specified by the comparator, in particular by the electronic components thereof. The output levels provide information about the magnitude of the voltage potential of the input signal.

The comparator is preferably in the form of a Schmitt comparator, also called a Schmitt trigger. A Schmitt comparator is distinguished in particular by its rapid switching properties. In other words: the Schmitt comparator switches hard and not soft. Furthermore, a Schmitt comparator has different input and output thresholds, that is to say switching hysteresis.

According to at least one embodiment, the monitoring output is connected to a comparator input of the Schmitt comparator and the switch is connected to a comparator output of the Schmitt comparator. In this context, "connection" of the comparator output and of the switch can mean both a direct connection and an indirect connection. In the case of a direct connection, the comparator output and the switch can be coupled directly, for example via a single conducting connection. In the case of an indirect connection, further electronic components, such as, for example, a relay, can be arranged between the comparator output and the switch. In the case of an indirect connection, it can thus be possible that a further step, such as, for example, activation or deactivation of a relay, is necessary in order to activate or deactivate the switch. The Schmitt comparator can thus serve to monitor the light-emitting diode, the output level of the Schmitt comparator controlling, that is to say activating and/or deactivating, the switch indirectly or directly.

The lighting system preferably comprises a shunt, also called an instrument shunt or measuring resistor, and a diode. The fault signal is then a voltage level at the monitoring output. The shut is preferably configured to convert a current of the light-emitting diode into a voltage, in particular a proportional voltage. The voltage can then correspond to the fault signal. The shunt can be connected in series with the at least one light-emitting diode. The voltage drop across the shunt can be tapped with the diode, that is to say can be present at the diode, the diode only becoming conducting at a threshold voltage. In other words, the voltage generated proportionally to the current is coupled out via the diode. The output of the diode can be coupled with the monitoring output.

The use of a shunt in conjunction with a diode can permit simple detection of a faulty light-emitting diode. Where there is no fault, that is to say in normal operation of the lighting system, the current flowing through the light-emitting diode is so small that the voltage drop at the shunt does not result in the diode becoming conducting. In the case of a defect in the light-emitting diode, an increase in the current in the light-emitting diode can occur, resulting in a higher voltage drop at the shunt. Depending on the resistance value of the shunt, the diode accordingly becomes conducting when there is a defect, whereby the fault signal is present at the monitoring output. If the fault signal is sufficiently high, the comparator then switches the output threshold into the "on" state, such that the switch is activated and the light-emitting diode is disconnected from the current source. If the light-emitting diode has at least one LED chain, that LED chain preferably comprises the shunt and the diode.

The lighting system is preferably designed such that the comparator comprises a first transistor and a second transistor. The transistors can be NPN transistors. The monitoring output is connected to the base of the first transistor. Thus, in the case of a defect, the fault signal is present at the base of the first transistor. It is further possible that the switch is coupled with the collector of the first transistor or of the second transistor. The transistors are preferably coupled with one another such that switching of the first transistor is accelerated by the second transistor. For that purpose, the collector of the first transistor can be coupled with the base of the second transistor, for example.

The first transistor and the second transistor can be connected with one another such that the first transistor blocks, that is to say is high-ohm, in fault-free normal operation of the lighting system ("off" state), that is to say when a fault signal is not present, and the second transistor conducts in fault-free normal operation. When there is a defect in the lighting system ("on" state), that is to say when a fault signal is present, the first transistor can be conducting and the second transistor can block. A small current through the second transistor in normal operation in particular allows the lifetime of the second transistor to be lengthened or, as the case may be, overloading of the comparator to be prevented. Furthermore, the lighting system can thereby have better efficiency. In dependence on the magnitude of the voltage present at the base of the first transistor, the two transistors switch in opposite directions to one another between the blocking state and the conducting state. For example, in the "on" state, a low level can be present at the comparator output, in particular at the collector of the first transistor, and a high level can be present at the collector of the second transistor.

According to at least one embodiment of the lighting system, the switch is opened in the activated state, that is to say, in the case of a defect. The switch is thus a normally closed contact. For example, the switch is connected in series with the current source and the light-emitting diode. In fault-free normal operation, the switch is closed and the current source is connected to the light-emitting diode. In the case of a defect, the control signal is present at the switch, such that the switch is opened and the current source is disconnected from the light-emitting diode.

According to at least one embodiment of the lighting system, the switch is closed in the activated state. The switch is thus a normally open contact. For example, the switch is connected in parallel with the current source and the at least one light-emitting diode. In the case of a defect, that is to say in the activated state, the switch is closed and short-circuits the current source, for example. The current source is then disconnected from the light-emitting diode. In the case of a short circuit of the current source, the current source can be designed to detect the short circuit and switch itself off.

The switch can be coupled with a relay or can be part of a relay. The relay can be a latched relay. A latched relay in particular changes the switch position only once, providing greater safety. The relay can be connected to the collector of the first transistor. In the case of a defect, the control signal is then present at the relay, such that the relay tightens. The switch integrated with the relay can then be opened or closed depending on whether the switch is connected in parallel or in series with the current source. Preferably, at least one terminal of the relay is connected to the current source, while the other terminal can be connected to the comparator output. It is thereby possible that a sufficiently high voltage is present at the coil of the relay and the relay tightens only in the case of a fault. Alternatively or in addition to a relay, the switch can be a mechanical and/or electronic switch, in particular a transistor such as, for example, a MOSFET.

According to at least one embodiment of the lighting system, the lighting system comprises a plurality of light-emitting diodes. For example, the light-emitting diodes are connected in parallel and are operated together by the current source. The light-emitting diodes can each be part of an LED chain. The lighting system can then comprise a plurality of LED chains. The light-emitting diodes, and where applicable the LED chains, can be of identical construction, that is to say each have the same components and/or semiconductor layers. In the case of a defect, preferably all the light-emitting diodes are disconnected from the current source.

Each light-emitting diode is preferably connected to a chain monitoring output. In the case of LED chains, each LED chain can include a chain monitoring output. The chain monitoring outputs are connected to one another and to the monitoring output. A fault signal of a light-emitting diode is present at the chain monitoring output associated with the light-emitting diode and thus also at the monitoring output.

According to at least one embodiment, in the case of a defect of one of the light-emitting diodes, the fault signal is present at the chain monitoring output of the defective light-emitting diode. This is the case in particular when a defective light-emitting diode leads to a current increase in the defective light-emitting diode. This is the case, for example, when there is a short circuit of the light-emitting diode.

According to at least one embodiment, in the case of a defect of one of the light-emitting diodes, the fault signal is present at the chain monitoring outputs of the non-defective light-emitting diodes. This is the case in particular when a defective light-emitting diode leads to a current reduction in the defective light-emitting diode. For example, this is the case with load shedding, that is to say with an "open" light-emitting diode. The current missing from the defective light-emitting diode, in particular in the associated LED chain, is then distributed to the other light-emitting diodes and leads to an increase in the current therein.

According to at least one embodiment of the lighting system, the lighting system has a plurality of light-emitting diodes. If the lighting system has at least one LED chain, the LED chain preferably contains a plurality of light-emitting diodes. In the case of a defect in one of the light-emitting diodes, the fault signal is present at the monitoring output. Only a single faulty light-emitting diode can thus lead to the current source being disconnected from the light-emitting diodes of the lighting system.

BRIEF DESCRIPTION OF THE FIGURES

The lighting system described herein is explained in greater detail below by means of exemplary embodiments and the associated figures.

DETAILED DESCRIPTION OF PREFERRED EXEMPLARY EMBODIMENTS

Figure 1:
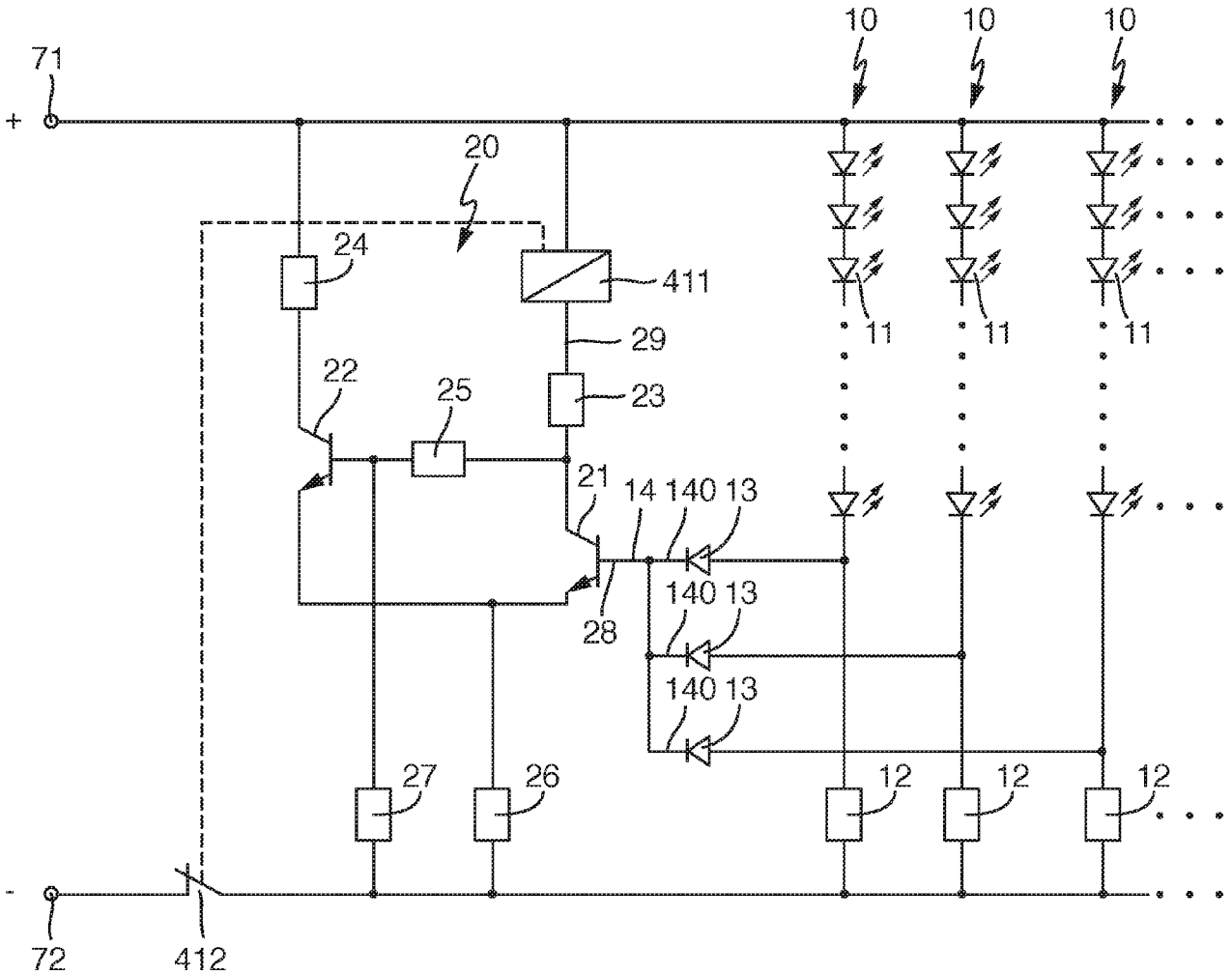
FIG. 1 shows a circuit diagram of a first exemplary embodiment of a lighting system described herein.

Preferred exemplary embodiments are described below by means of the figures. Elements in the figures that are the same, of the same type or have the same effect are provided with the same reference numerals. Furthermore, a repeated description of such elements is in some cases not given, in order to avoid redundancies. The figures and the relative proportions of the elements shown in the figures are not to be considered as being to scale. Rather, the size of some elements may be exaggerated for the purpose of better clarity and/or for better understanding.

A first exemplary embodiment of a lighting system described herein is explained in greater detail by means of the circuit diagram of FIG. 1. The lighting system comprises a plurality of LED chains 10, a comparator 20, a relay 411 coupled with a switch 412, and a current source 71, 72 having a positive pole 71 and a negative pole 72.

The LED chains 10 are connected in parallel with one another. Each LED chain 10 contains a plurality of light-emitting diodes 11, a shunt 12, a diode 13 and a chain monitoring output 140. The chain monitoring outputs 140 of the LED chains 10 are connected to one another and are fed into a common monitoring output 14. The LED chains 10 can in particular be of identical construction. In this case it is possible that the same current, within the limits of the manufacturing tolerances, flows through the LED chains 10.

In the second exemplary embodiment, the comparator 20 is in the form of a Schmitt comparator having a comparator input 28 and a comparator output 29. The comparator 20 comprises a first transistor 21, a second transistor 22, a first resistor 23, a second resistor 24, a third resistor 25, a fourth resistor 26 and a fifth resistor 27. The first transistor 21 and the second transistor 22 are in the present case each in the form of NPN transistors. An NPN transistor comprises a collector, an emitter and a base. The switching threshold of the comparator 20 can be adjusted by means of the resistors 23, 24, 25, 26, 27. The comparator 20 can further contain electronic components not shown in the figures, such as, for example, capacitors, by means of which precise adjustment (so-called fine tuning) of the switching threshold is possible.

The first resistor 23 and the second resistor 24 can each be a collector resistor of the first transistor 21 and the second transistor 22, respectively. A collector current of the respective transistor can be adjusted or, as the case may be, limited by the collector resistors. The third resistor 25 and the fifth resistor 27 can form a base voltage divider of the base of the second transistor 22, by means of which the threshold voltage of the comparator can be adjusted, for example. The fourth transistor 26 can be a common emitter resistor of the first transistor 21 and the second transistor 22, by means of which DC wise coupling between the two transistors can be established.

A mode of functioning of the comparator 20 shown in FIG. 1 (and likewise in FIG. 2) is, for example, as follows. In the case of a small voltage at the comparator input 28, no base current flows in the first transistor 21. The first transistor 21 is thus blocked, and approximately the operating voltage provided by the current source 71, 72 is present at the collector thereof. In this case, a high base current flows in the second transistor 22, that is to say, the second transistor 22 is conducting. The output voltage at the arm of the second transistor 22 can be determined by the ratio of the third resistor 25 to the fifth resistor 27.

If the input voltage slowly increases, for example as a result of a defect, those ratios do not change at first because the emitter is already at a positive potential. If the input voltage is sufficiently large, in particular if the threshold voltage is exceeded, the first transistor 21 begins to become conducting. As a result, the collector voltage falls and the second transistor 22 starts to block. The current through the common fourth resistor 26 is thus also reduced, and the emitter potential falls. The first transistor 21 is then conducting and the second transistor 22 blocks.

The switch 412 of the lighting system according to the first exemplary embodiment is coupled with a relay 411. The relay 411 is connected to the collector of the first transistor 21, while the normally closed contact 412 is connected in series with the current source 21, 22. The relay 411 is designed such that the switch 412 is closed in fault-free normal operation, that is to say it is a normally closed contact. In other words: the switch 412 is open in the activated state and closed in the deactivated state.

In particular, a first terminal of the relay 411 can be connected to the collector of the first transistor 21, which in the present case forms the comparator output 29. A second terminal of the relay 411 can be connected to a fixed supply point of the current source 71, 72. In the exemplary embodiment shown in FIG. 1, the second terminal of the relay 411 is connected to the positive pole 71. An alternative circuit, in which the second terminal of the relay 411 is connected to the negative pole 72, is also possible, however. In fault-free operation, that is to say with a high-ohm first transistor 21, the coil voltage of the relay 411 is approximately 0 volts.

During operation, a defect of one of the light-emitting diodes 11 can occur. In the case of a short circuit, the current at the defective light-emitting diode 11 increases. The shunt 12 of the LED chain 10 having the defective light-emitting diode 11 converts this increasing current into a voltage fault signal, which is tapped by means of the diode 13 of the LED chain 10. In the case of a sufficiently great fault signal, the diode 13 becomes conducting and the fault signal is present at the chain monitoring output 140 of the LED chain 10 having the defective light-emitting diode 11.

The defect can, however, also be load shedding, that is to say an open light-emitting diode 11. In this case, the current at the defective light-emitting diode 11, and thus also in the LED chain having the defective light-emitting diode 11, falls. The total current provided by the current source 71, 72 is then divided between the remaining LED chains 10, such that the current in those remaining LED chains 10 increases. This increasing current in the LED chains 10 that do not contain a defective light-emitting diode 11 is converted by the shunts 12 of those LED chains 10 into a fault signal, which is present at the chain monitoring outputs 140 of the LED chains 10 without a defective light-emitting diode 11.

Both in the case of a short circuit and in the case of load shedding, a fault signal is then present at the monitoring output 14. The monitoring output 14 is connected to the comparator input 28 of the comparator 20, which in turn is connected to the base of the first transistor 21. The fault signal leads to the first transistor 21 becoming conducting and a control signal being present at the comparator output 29 connected to the relay 411. In this case, the potential at the comparator output 29 "jumps" towards zero, such that a sufficiently high coil voltage is then present across the relay 411. The relay 411 located in the collector circuit of the first transistor 21 then tightens and opens the switch 412. This leads to the current source 71, 72 being electrically disconnected from the LED chains 10. In other words, the current circuit is broken and load shedding takes place.

Figure 2:
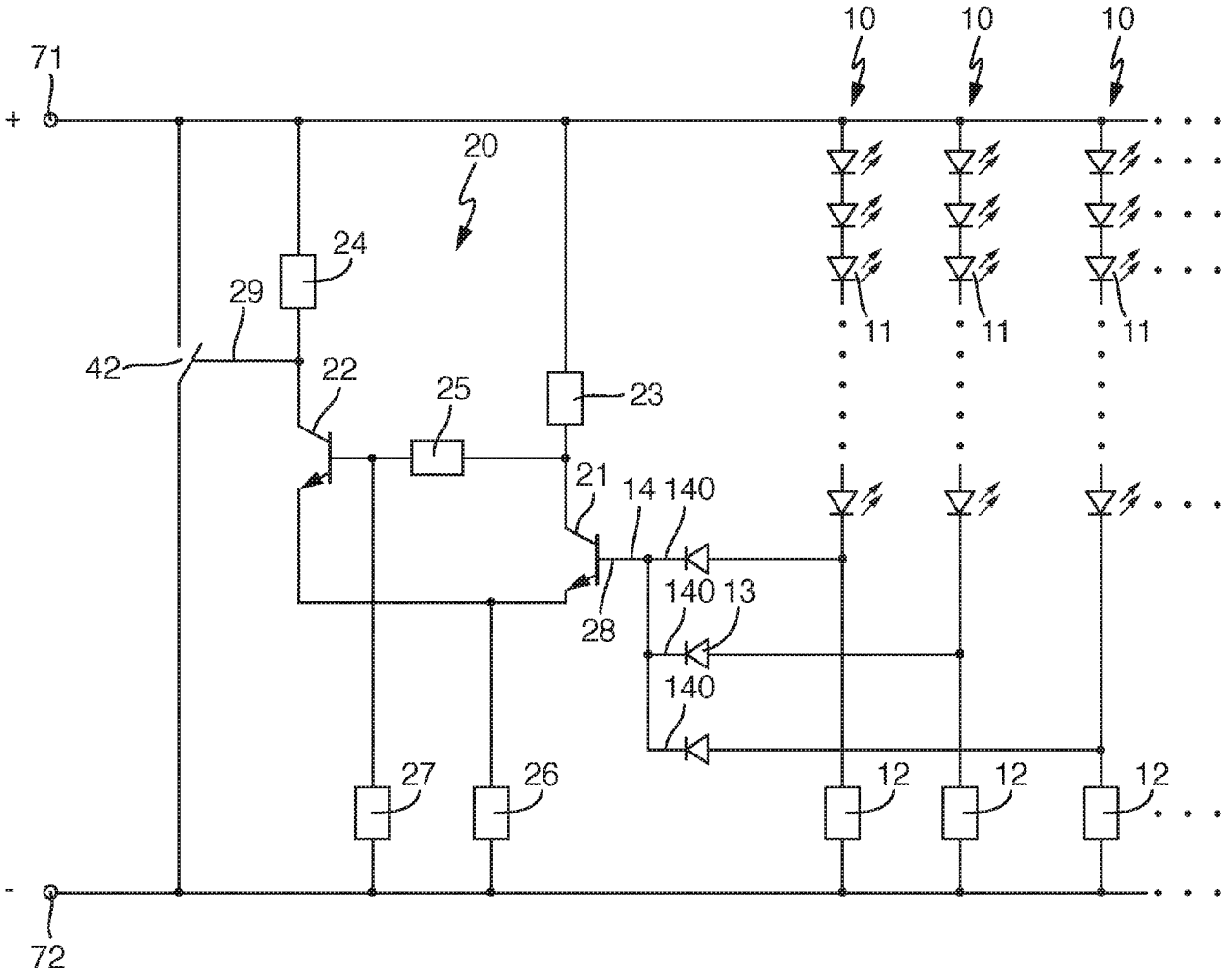
FIG. 2 shows a circuit diagram of a second exemplary embodiment of a lighting system described herein.

A second exemplary embodiment of a lighting system described herein is explained in greater detail by means of the circuit diagram of FIG. 2. The lighting system of the second exemplary embodiment is similar in construction to the lighting system of the first exemplary embodiment, such that only the different features are discussed hereinbelow.

The lighting system according to FIG. 2 comprises a switch 42 which forms a parallel circuit with the LED chains 10. The switch 42 is connected to the comparator output 29 of the comparator 20. The switch 42 can be a MOSFET. The switch 42 is in such a form that it is open in normal operation. In other words, the switch 42 is open in the activated state and closed in the deactivated state. It is thus a normally open connector. In the case of a defect of a light-emitting diode 11, the switch 42 is switched by means of the control signal present at the comparator output 29 and closed. The current source 71, 72 is thereby short-circuited, such that the LED chains 10 of the lighting means are no longer supplied with a voltage.

The lighting system can also contain a combination of the two exemplary embodiments of FIGS. 1 and 2. For example, the relay 411 shown in FIG. 1 can be coupled with a normally open contact which short-circuits the current source 71, 72 in the event of a defect.

The lighting system described herein makes it possible to detect not only a short circuit of a light-emitting diode but also an "open" light-emitting diode and then to disconnect the lighting system safely from the ballast. A safe lighting system for an LED retrofit lamp, for example, can thereby be provided in a simple, robust and cost-saving manner.

The invention is not limited by the description by means of the exemplary embodiments to those exemplary embodiments. Rather, the invention includes any novel feature and any combination of features, which in particular includes any combination of features in the patent claims, even if that feature or that combination is not itself explicitly described in the patent claims or exemplary embodiments.

LIST OF REFERENCE NUMERALS

10 LED chain
11 light-emitting diode
12 shunt
13 diode
14 monitoring output
140 chain monitoring output
20 comparator
21 first transistor
22 second transistor
23 first resistor
24 second resistor
25 third resistor
26 fourth resistor
27 fifth resistor
28 comparator input
29 comparator output
411 relay
412 switch (normally closed connector)
42 switch (normally open connector)
71 positive pole of the current source
72 negative pole of the current source

The invention claimed is:

1. A lighting system comprising
at least one light-emitting diode,
a monitoring output, at which a fault signal is present in the case of a defect in the light-emitting diode during operation of the lighting system,
a switch for switching a connection between a current source and the light-emitting diode, and
a comparator which is coupled with the monitoring output and the switch, wherein
the current source is disconnected from the light-emitting diode in an activated state of the switch, and
the comparator is configured to switch the switch into the activated state when the fault signal is present at the monitoring output.

2. The lighting system according to claim 1, wherein the defect is a short circuit of the light-emitting diode and/or load shedding of the light-emitting diode.

3. The lighting system according to claim 1, wherein the comparator is a Schmitt comparator.

4. The lighting system according to claim 3, wherein the monitoring output is connected to a comparator input of the Schmitt comparator and the switch is connected to a comparator output of the Schmitt comparator.

5. The lighting system according to claim 1, wherein the light-emitting diode is connected to a shunt and a diode, and the fault signal is a voltage level at the monitoring output.

6. The lighting system according to claim 1, wherein the comparator has a first transistor and a second transistor and the monitoring output is connected to the base of the first transistor.

7. The lighting system according to claim 1, wherein the switch is opened in the activated state.

8. The lighting system according to claim 1, wherein the switch is closed in the activated state.

9. The lighting system according to claim 1, wherein the switch short-circuits the current source in the activated state.

10. The lighting system according to claim 1, comprising a plurality of light-emitting diodes, each of which is connected to a chain monitoring output, wherein each chain monitoring output is coupled with the monitoring output.

11. The lighting system according to claim 10, wherein, when there is a defect in one of the light-emitting diodes, the fault signal is present at the chain monitoring output of the defective light-emitting diode.

12. The lighting system according to claim 10, wherein, when there is a defect in one of the light-emitting diodes, the fault signal is present at the chain monitoring outputs of the non-defective light-emitting diodes.

13. The lighting system according to claim 1, comprising a plurality of light-emitting diodes, wherein, when there is a defect in one of the light-emitting diodes, the fault signal is present at the monitoring output.

* * * * *